United States Patent [19]

Otrhalek et al.

[11] Patent Number: 4,531,978

[45] Date of Patent: Jul. 30, 1985

[54] METHOD OF FORMING CHROMATE CONVERSION COATINGS ON ALUMINUM SURFACES AND THE COATING FORMED THEREBY

[75] Inventors: Joseph V. Otrhalek, Dearborn, Mich.; Donald R. Gerard, Bowling Green, Ky.

[73] Assignee: Detrex Chemical Industries, Inc., Southfield, Mich.

[21] Appl. No.: 483,775

[22] Filed: Apr. 11, 1983

[51] Int. Cl.[3] ..... C23F 7/26; C23F 7/10

[52] U.S. Cl. ..... 148/6.16; 148/6.2; 148/6.27

[58] Field of Search ..... 148/6.2, 6.16, 6.27; 427/57

[56] References Cited

U.S. PATENT DOCUMENTS 4,328,047 5/1982 Dalton ..... 427/57
4,353,934 10/1982 Nakashima ..... 427/57

FOREIGN PATENT DOCUMENTS 2818160 11/1978 Fed. Rep. of Germany ..... 427/57
730877 5/1980 U.S.S.R. ..... 427/57

*Primary Examiner*—Sam Silverberg
*Attorney, Agent, or Firm*—Paul & Paul

[57] ABSTRACT

A method for forming a chromate conversion coating on aluminum surfaces is described in which an aluminum surface is immersed in an aqueous acidic solution containing hexavalent chromium and the aluminum surface and the solution are subjected to ultrasonic energy thus reducing the need for including environmentally harmful accelerator components in said solution.

11 Claims, No Drawings

METHOD OF FORMING CHROMATE CONVERSION COATINGS ON ALUMINUM SURFACES AND THE COATING FORMED THEREBY

BACKGROUND OF INVENTION

For many years, chromate conversion coatings have been applied to aluminum surfaces and surfaces of aluminum alloys to prevent corrosion. The compositions for forming these coatings contain, in addition to hexavalent chromium and activators such as fluorine, compounds to accelerate the reaction rate for chromate conversion coating on a volume basis. Due to the dramatic accelerating effect of potassium ferricyanide, it is the most common accelerator employed. Other accelerators enjoying limited use include molybdenum, vanadium and tungsten salts.

However, these accelerators, especially potassium ferricyanide, are toxic and they are environmentally harmful. These accelerators form toxic waste products of the conversion coating process and, due to the possible serious environmental consequences, become a serious disposal problem. The liability which may arise from utilizing these toxic chemicals as accelerators continues after disposal of the chemicals and cannot be avoided. There are other disadvantages to using such accelerators. Compounds such as potassium ferricyanide decompose during the conversion coating process, requiring repeated replenishment. Futhermore, ferricyanide compositions are also known to decompose into highly toxic hydrogen cyanide gas, thereby endangering workers. As a result, conversion coating processes have been sought which could, without the use of harmful accelerators, achieve effective coatings at a rate high enough to coat aluminum surfaces on a volume basis. Until the present invention, the results of this search have been largely negative.

The process of the present invention alleviates these problems by reducing the need for these environmentally harmful accelerators, while achieving effective chromate conversion coatings at acceptable coating rates.

SUMMARY OF THE INVENTION

The process of the present invention consists broadly of immersing an aluminum or aluminum alloy surface in a chromate conversion coating bath while exposing the immersed surface to ultrasonic energy and controlling the ultrasonic power environment to which the aluminum surface is exposed.

We have discovered that when ultrasonic energy is applied within a limited effective range to an aluminum or aluminum alloy surface immersed in an accelerator-free aqueous hexavalent chromium coating bath, satisfactory conversion coating action is achieved. This conversion coating reaction produces effective chromate coatings at coating rates high enough to coat aluminum surfaces on a volume basis. Therefore, the problem-laden accelerators such as potassium ferricyanide previously included in the coating solutions may now be eliminated through the practice of this invention.

The ultrasonic energy effective range may be controlled by varying the energy produced by ultrasonic transducers or by varying the positions of such transducers and the aluminum or aluminum alloy surface relative to each other so that the metallic surface passes through zones of varying energy intensities inherent to energy produced by ultrasonic transducers. The preferred frequency range for such ultrasonic energy lies in the range from about 18 kilohertz to about 60 kilohertz.

DETAILED DESCRIPTION OF THE INVENTION

The method of this invention comprises immersing an aluminum or aluminum alloy surface in a hexavalent chromium conversion coating bath and exposing the bath and aluminum surface to ultrasonic energy. The standard chromate conversion coating solutions without the previously employed environmentally harmful accelerators, such as potassium ferricyanide, is used. Even without these accelerators, effective coatings and acceptable coating rates are obtained through the practice of the present invention.

In the preferred embodiment, the chromate conversion coating solution consists essentially of an aqueous solution containing hexavalent chromium ions in a concentration in the range of from about 0.5 g/l to about 10 g/l and fluorine ions in a concentration in the range of about 0.2 g/l to about 4 g/l. The solution is applied at a temperature within the range of from about 60° F. to about 160° F., and at a pH within the range of from about 0.8 to about 2.2. An alternative preferred embodiment of the solution consists essentially of an aqueous solution containing hexavalent chromium ions, fluorine ions and phosphate ions in concentrations in the ranges of about 1 g/l to about 10 g/l, about 0.2 g/l to about 4 g/l, and about 0.5 g/l, to about 60 g/l, respectively.

The acidity of the solution must be maintained in the stated pH range in part to inhibit the reduction of Cr(VI) to Cr(III). Chromic acid may be used as a source of hexavalent chromium. Other sources of Cr(VI) include sodium chromate, sodium dichromate and potassium chromate and potassium dichromate. Fluorine sources include hydrofluoric acid, potassium titanium fluoride, nickel fluoride, calcium fluoride, ammonium silco fluoride, sodium fluoroborate, sodium fluoride, sodium bifluoride, potassium fluoride and potassium bifluoride and ammonium bifluoride. The proper acidic environment may be maintained through addition of an acidic chromium source, such as chromic acid, and an acidic fluorine source, such as hydrofluoric acid. The acidic environment may also be achieved by adding an acid, such as nitric acid. If the solution is too acidic, such as occurs upon addition of large amounts of chromic acid, the excess acid may be neutralized by addition of an alkali such as ammonium hydroxide.

The process of the present invention is applicable to aluminum and aluminum alloys such as 2024 aluminum, 3003 aluminum, 1100 aluminum, 7075 aluminum and 6061 aluminum.

The following examples illustrate that optimum results are obtained when reduced ultrasonic energy is applied. The preferred frequency range for such ultrasonic energy lies in the range from about 18 kilohertz to about 60 kilohertz.

EXAMPLE 1

Aluminum panels, 4"×12" panels of 2024 aluminum, were first thoroughly cleaned with an alkaline cleaner and then rinsed by dipping for one minute in a warm water rinse. An aqueous solution was prepared including the following ingredients in the following concentrations:

Chromium ion as Cr(VI)—5.3 g/l

Fluorine ion as $F^-$—1.7 g/l
Nitrate ion as $NO_3^-$—1.3 g/l
Water—Balance to 1 liter.

Sixty-four gallons of the aqueous solution at 140° F. were put into a stainless steel container measuring two feet square and two feet deep. Within the container and attached to the bottom thereof were two stainless steel containers containing piezoelectric type transducers generating ultrasonic energy at about 26.5 kilohertz. Each of the two transducers was rated at 350 watts at full power with the power being variable. The distance from the top of the transducer containers to the top of the solution was 18 inches. The top edges of the aluminum panels were placed one inch below the surface of the solution at various ultrasonic power settings and held stationary in the solution for various lengths of time as shown in the table below. The aluminum panels were then rinsed by two one-minute dips in cold water and a passivating rinse. Next, the aluminum panels were spray tested for corrosion resistance. The results are presented in the table below:

| % of Full Ultrasonic Power | COATING WEIGHT MG/FT² Coat. Time: ½ Min. | ¾ Min. | 1 Min. | 2 Min. | SPRAY TEST HRS. BEFORE PITTING Coat. Time: ½ Min. | ¾ Min. | 1 Min. | 2 Min. |
|---|---|---|---|---|---|---|---|---|
| 0 | 16 | 21 | 21* | 29* | 24 | 24 | 24 | 24 |
| 3.1 | 11 | 24 | 25 | 28* | 24 | 24 | 24 | 48 |
| 7.5 | 22 | 24 | 25 | 43* | 24 | 24 | 24 | 48 |
| 11.2 | 20 | 18 | 36* | 42* | 24 | 24 | 48 | 48 |
| 16 | 24 | 18 | 24 | 20 | 24 | 24 | 24 | 24 |
| 86 | 12 | 13 | 19 | 23 | 24 | 24 | 24 | 48 |

Coat. Time is the length of time the test panel was held in solution.
*Coatings noted by * had smooth regular coatings. All other coatings had lighter color, were not as smooth and had much coarser coatings.

EXAMPLE 2

The process of Example 1 was followed except that the solution contained additionally 1.3 g/l of phosphate ion as $PO_4^-$.

The following results were obtained:

| % of Full Ultrasonic Power | COATING WEIGHT MG/FT² Coat. Time: ½ Min. | ¾ Min. | 1 Min. | 2 Min. | SPRAY TEST HRS. BEFORE PITTING Coat. Time: ½ Min. | ¾ Min. | 1 Min. | 2 Min. |
|---|---|---|---|---|---|---|---|---|
| 0 | 18 | 22 | 40* | 65* | 24 | 24 | 48 | 48 |
| 7.5 | 35 | 49 | 74* | 287* | 24 | 48 | 48 | 320 |
| 16 | 36 | 49 | 79* | 192* | 48 | 48 | 160 | 320 |
| 33.5 | 39 | 48 | 77* | 156* | 48 | 48 | 160 | 240 |
| 86 | 54 | 55 | 69 | 72 | 48 | 48 | 48 | 48 |

Coat. Time is the length of time the test panel was held in solution.
*Coatings noted by * had smooth regular coatings. All other coatings had lighter color, were not as smooth and had much coarser coatings.

Although, in the examples, 2024 aluminum was coated, it should be understood that aluminum or other alloys of aluminum may be coated in this manner. It is further understood that even though the aluminum panels were held stationary while the ultrasonic power was varied, the process of this invention may be carried out by varying the distance between the aluminum surface and the power source.

We claim:

1. The method of forming a regular chromate conversion coating on a metal surface said metal selected from the group consisting of aluminum and alloys of aluminum comprising immersing said surface in an accelerator-free aqueous acidic solution containing hexavalent chromium ions and at least one activator, subjecting said metal surface and said solution to ultrasonic energy generated from about 18 kilohertz to about 60 kilohertz by an ultrasonic transducer wherein the intensity of said ultrasonic energy impinging upon said immersed metal surface is an amount within the range of from about 0.00565 W/Cm² to about 0.0631 w/CM².

2. The process of claim 1 in which the positions of said immersed metal surface and such ultrasonic transducers relative to each other are varied whereby said immersed metal surface passes repeatedly through said varying zones of energy intensities by moving said immersed metal surface repeatedly through said varying zones of energy while such ultrasonic transducers are maintained in a stationary position.

3. The process of claim 1 in which the positions of said immersed metal surface and such ultrasonic transducers relative to each other are varied whereby said immersed metal surface passes repeatedly through said varying zones of energy intensities by maintaining said immersed metal surface in a stationary position and moving such ultrasonic transducers repeatedly such that said zones of varying energy intensities repeatedly pass over said immersed metal surface.

4. The process of claim 1 in which the positions of said immersed metal surface and such ultrasonic transducers relative to each other are varied whereby said immersed metal surface passes repeatedly through said varying zones of energy intensities by moving said immersed metal surface and such ultrasonic transducers repeatedly such that said immersed metal surface passes through said zones of varying energy intensities.

5. The process of claim 1 wherein said immersed metal surface is subjected to ultrasonic energy for a limited time and said immersed metal surface is retained in said conversion coating bath for a limited time thereafter while said conversion coating proceeds.

6. The method of claim 1 wherein said aqueous solution contains fluorine ions and said ultrasonic energy intensity impinging upon said surface is no more than about 0.0211 W/cm².

7. The method as in claim 1 wherein said aqueous solution consists essentially of an aqueous solution containing hexavalent chromium ions in a concentration in the range of from about 0.5 g/l to about 10 g/l and fluorine ions in a concentration in the range of from about 0.2 g/l to about 4 g/l.

8. The method as in claim 1 wherein said aqueous solution consists essentially of an aqueous solution containing hexavalent chromium ions in a concentration in the range of from about 1 g/l to about 10 g/l, fluorine ions in a concentration in the range of from about 0.2 g/l to about 4 g/l, and phosphate ions in a concentration in the range of from about 0.5 g/l to about 60 g/l.

9. The method of claim 6 wherein said aqueous solution consists essentially of about 5.3 g/l Cr (VI), about 1.7 g/l $F^-$, 1.3 g/l $NO_3^-$ and the balance to one liter of $H_2O$.

10. The method of claim 1 wherein said aqueous solution consists essentially of 1.7 g/l $F^-$ and 1.3 g/l $PO_4^-$ and the balance to one liter of $H_2O$.

11. The process of claim 1 wherein said ultrasonic transducer inherently produces varying zones of energy intensities within said conversion coating bath, and varying the positions of said immersed metallic surface and said ultrasonic transducer relative to each other whereby said immersed metal surface passes repeatedly through said varying zones of energy intensities.

* * * * *